US005470252A

United States Patent [19]

Fladung

[11] Patent Number: 5,470,252

[45] Date of Patent: Nov. 28, 1995

[54] LIGHT-PERMEABLE EXTENSION CORD CONNECTOR

[75] Inventor: Philip E. Fladung, Carmel, Ind.

[73] Assignee: Woods Industries, Inc., Carmel, Ind.

[21] Appl. No.: 258,791

[22] Filed: Jun. 13, 1994

Related U.S. Application Data

[63] Continuation of Ser. No. 4,096, Jan. 13, 1993, Pat. No. 5,320,560, which is a continuation of Ser. No. 740,820, Aug. 6, 1991, abandoned.

[51] Int. Cl.[6] ..... H01R 3/00

[52] U.S. Cl. ..... 439/490; 439/910

[58] Field of Search ..... 439/106, 369, 439/490, 491, 502, 677, 910, 681; 340/656, 687

[56] References Cited

U.S. PATENT DOCUMENTS

| | | | |
|---|---|---|---|
| Re. 24, 393 | 11/1957 | McCarthy . | |
| D. 195,463 | 6/1963 | Tamarin . | |
| D. 271,042 | 10/1983 | Giannola . | |
| D. 273,335 | 4/1984 | Bannigan . | |
| D. 286,134 | 10/1986 | Schwartz . | |
| 1,935,771 | 11/1933 | Feurstein et al. . | |
| 2,112,137 | 3/1938 | Brach . | |
| 2,391,325 | 12/1945 | Maurette . | |
| 2,503,677 | 4/1950 | McHenry et al. | 439/490 |
| 2,518,812 | 8/1950 | Oswald . | |
| 2,696,607 | 12/1954 | Witkin . | |
| 2,863,038 | 12/1958 | Lombardo . | |
| 3,020,518 | 2/1962 | Camping et al. | 439/910 X |
| 3,294,968 | 12/1966 | Cloyd . | |
| 3,308,289 | 3/1967 | Conradi . | |
| 3,604,920 | 9/1971 | Niles . | |
| 3,733,478 | 5/1973 | Barker . | |
| 3,757,102 | 9/1973 | Roberts . | |
| 3,775,102 | 9/1973 | Roberts . | |
| 4,118,690 | 10/1978 | Paynton . | |
| 4,307,925 | 12/1981 | Drew . | |
| 4,369,487 | 1/1983 | Carlow . | |
| 4,386,818 | 6/1983 | Millhimes et al. . | |
| 4,413,312 | 11/1983 | Morkosky, Sr. et al. . | |
| 4,520,239 | 6/1987 | Schwartz . | |
| 4,671,597 | 6/1987 | Grill . | |
| 4,867,701 | 9/1989 | Wiand . | |
| 4,907,118 | 3/1990 | Homes . | |
| 4,911,652 | 3/1990 | Savoca et al. | 439/488 X |
| 4,958,267 | 9/1990 | Baake . | |
| 5,007,857 | 4/1991 | Wright . | |
| 5,062,807 | 11/1991 | Guss, III | 439/490 |
| 5,207,594 | 5/1993 | Olson . | |

FOREIGN PATENT DOCUMENTS

| | | |
|---|---|---|
| 1515748 | 4/1969 | Germany . |
| 2140223 | 11/1984 | United Kingdom . |
| 2184615 | 6/1987 | United Kingdom . |
| 2232016 | 11/1990 | United Kingdom . |

OTHER PUBLICATIONS

Four photocopies of the plug and receptacle on an extension cord purchased by the Examiner between Jun. 1981 and Nov. 1981.

Plug in Waber Industries brochure.

Plugs and receptacles on p. 82 of *MCM Electronics* Spring 1991 catalog No. 26.

Carol extension cord on p. 4 of *Hardware Age* Feb. 1988.

Disclosure document dated Apr. 5, 1990 by Thomas R. Olson.

*Primary Examiner*—Khiem Nguyen

*Attorney, Agent, or Firm*—McAndrews, Held, & Malloy, Ltd.

[57] ABSTRACT

An extension cord connector construction wherein the connector components, including a visual power indicator, are encapsulated within a solid, light-permeable body to form the connector. By suspending the components in this manner, the lamp can be seen from a wide range of viewing angles. Furthermore, the body of the connector acts as a shock absorber or cushion which limits the damaging effects of mechanical stresses and improves the structural integrity of the connections within the connector.

23 Claims, 1 Drawing Sheet

LIGHT-PERMEABLE EXTENSION CORD CONNECTOR

CROSS REFERENCE TO RELATED APPLICATIONS

This application is a continuation of our application Ser. No. 08/004,096 filed Jan. 13, 1992, now U.S. Pat. No. 5,320,560 which is a continuation of our application Ser. No. 07/740,820 filed Aug. 6, 1991, now abandoned.

BACKGROUND OF THE INVENTION

The present invention relates to an extension cord construction and, more particularly, to a durable extension cord connector which provides a visual indication of power availability throughout a wide-range of viewing angles.

For the sake of safety and convenience, it is desirable to know whether an electrical extension cord is being supplied with power. Heretofore, prior electrical connectors have used lamps of the neon variety to visually indicate that power is being supplied to the connector. U.S. Pat. No. 4,671,597 shows an electrical extension cord having a lamp which is provided at the female end of the cord for indicating that power is available. The female end is formed from a multiple part assembly which includes an enclosure within which a lamp is mounted. One side of the enclosure includes a transparent plastic window which permits the lamp to be seen from the outside of the connector. The lamp is illuminated when power is supplied to the female end of the cord.

Such female cord receptacles are disadvantageous in several respects. Light emanating from the lamp is restricted to a single surface or area of the female receptacle housing. This limits the range of angles from which the lamp can be seen. Additionally, the multiple part construction of the female receptacle assembly fails to provide adequate protection to the connections therein from stresses due to mechanical shock. When an extension cord is used in an active work area where the cord is thrown about and handled roughly, the lamp can be vibrated and damaged. Parts of the lamp assembly may become loose and disconnected, or may break. In addition, moisture may find its way into the lamp enclosure and condensate on the viewing window.

It's therefore an object of the present invention to provide an improved electrical connector having a visual power indicator.

It is a further object of the present invention to improve the viewability of a visual power indicator disposed within a plug or receptacle electrical connector.

It is a further object of the present invention to increase the mechanical integrity of an electrical connector having a visual power indicator.

It is yet another object of the invention to provide an electrical connector having a shock resistible visual indicator for displaying a power-available indication over a wide range of viewing angles.

SUMMARY OF THE INVENTION

These and other objects of the invention are achieved in an extension cord connector, for example, a female receptacle, having a visual power indicator suspended within a solid, light-permeable body which is molded in shape to form the receptacle housing. By suspending the indicator in this manner, the visual power indicator can be seen from a wide range of viewing angles. The body of the connector acts as a shock absorber which limits damaging effects of mechanical stresses and improves the structural integrity of the connections between the components within the connector. In one embodiment, a plurality of surface faces are molded into the housing to refract the light in a plurality of viewing angles.

DESCRIPTION OF THE PREFERRED EMBODIMENT

Figure 1:
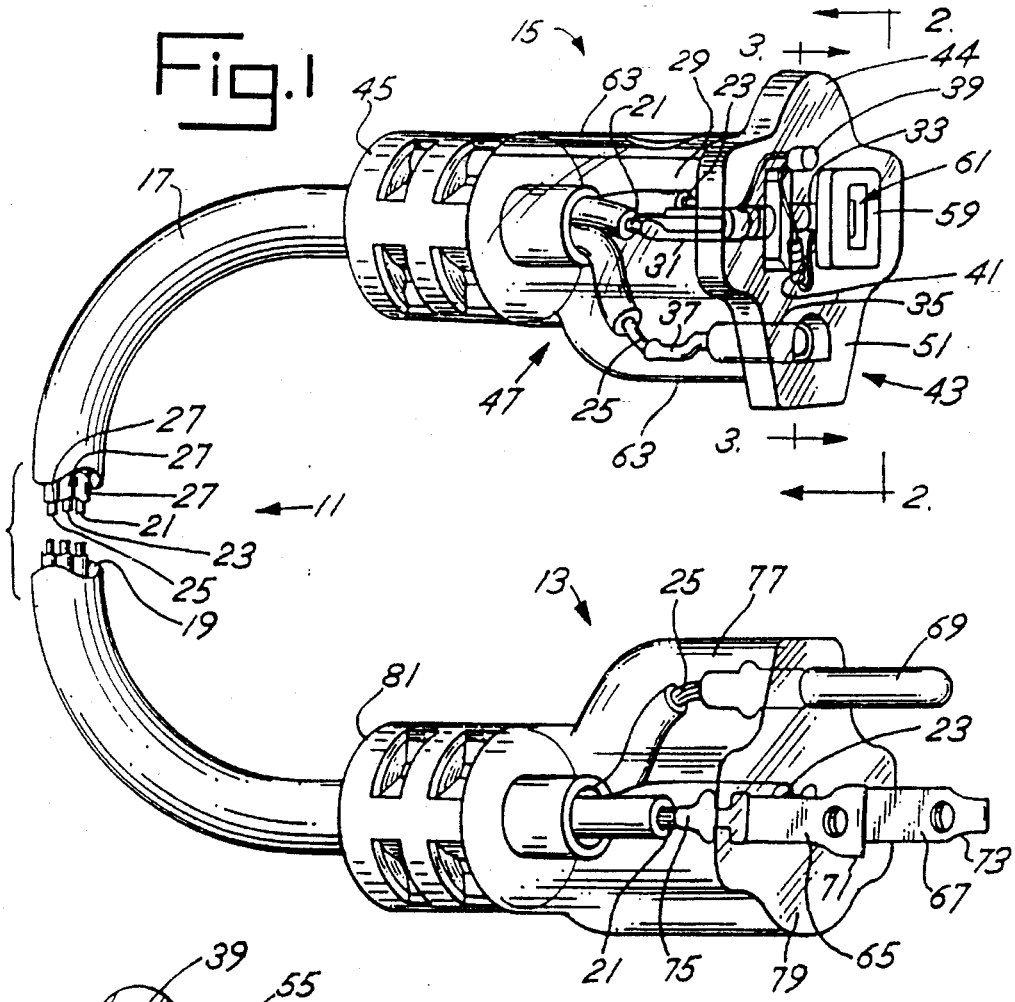
FIG. 1 is a perspective view of an extension cord having an electrical connector constructed in accordance with a preferred embodiment of the present invention.

Referring to FIG. 1, an extension cord 11 includes a male electrical connector 13, a female electrical connector or receptacle 15 and an electrical cable 17 extending between the male and female connectors 13, 15. Cable 17 comprises an outer insulating sheath 19 enclosing a "hot" or line conducting wire 21, a "neutral" conducting wire 23 and a "ground" conducting wire 25. Each of the wires 21, 23, 25 is provided with its own insulating sheath 27. Cable 17 may be, for example, a 10, 12, 14 or 16 gauge wire cable.

Figure 3:
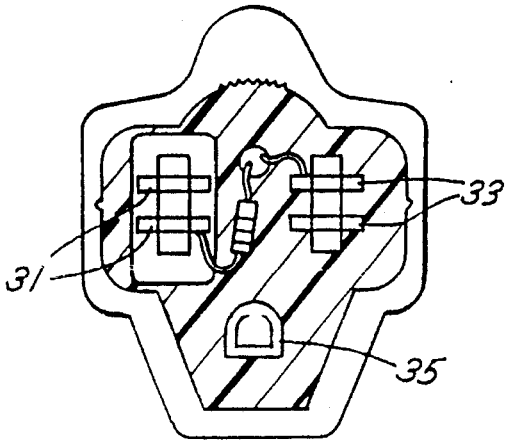
FIG. 3 is a cross-sectional view of the female receptacle of the extension cord of FIG. 1 taken along line 3—3.

Female connector 15 is formed of a plastic molded housing 29 which is, for example, injection molded using conventional molding techniques. Housing 29 is molded so as to encapsulate a hot blade receiving terminal 31, a neutral blade receiving terminal 33 and a ground plug receiving terminal 35. Hot and neutral blade receiving terminals 31, 33 are substantially identical and differ only with respect to their positions within housing 29. The receiving terminals are made of metal and formed of a size for receiving the blade or prong terminals of a conventional plug in electrical conducting engagement. Each receiving terminal 31, 33 is generally u-shaped having a slot for receiving a metal blade. Plug terminal 35 is shaped as hollow cylinder generally domed shaped, as shown in FIG. 3.

Hot and neutral blade receiving terminals 31, 33 and ground plug receiving terminal 35 are respectively connected to hot, neutral and ground conducting wires 21, 23, 25. Blade receiving terminals 31, 33 and ground plug receiving terminal 35 each include a metal distal connecting portion 37 (one referenced) which is tightly crimped about its respective conducting wire 21, 23, 25 in order to form an electrical and mechanical connection. The three terminals 31, 33, 35 are crimped about their respective wires prior to injection molding of housing 29 which encapsulates the terminals, a portion of each wire and part of the outer sheath 19.

A visual indication of the availability of power at the female receptacle 15 is provided by a lamp 39 which may be a subminature red neon lamp. Such a lamp is manufactured by CHI EN. Lamp 39 is connected in series with a resistor 41, which may be a 33K ohm resistor of one-quarter watt power rating. The series connected lamp and resistor are, in turn, connected between blade receiving terminals 31 and 33 for illumination of the lamp when power is supplied to the female connector 15. As will suggest itself, the series connected lamp and resistor may also be connected between the hot blade receiving terminal 31 and ground plug receiving terminal 35. As will further suggest itself, the serial order of the lamp and resistor is a matter of choice.

Lamp 39 and resistor 41 may be connected together by a U-shaped brass band 40 (FIG. 2) which is crimped into a B-shape around the ends of lamp 39 and resistor 41. The other ends of lamp 39 and resistor 41 may be crimped within the separate metal connecting portions 37.

Housing 29 is molded to include a front flange area 43, a flat circular rear surface 45, and a mid-body region 47. Cable 17 extends through rear surface 45 with its outer sheath 19 intact. Within the housing 29, sheath 19 has been removed from the ends of the wires 21, 23, 25 allowing the three wires to separate from one another and reach the location of their respective receiving terminal. A length of the individual sheath 27 of each separate wire is removed from the end of each wire to facilitate electrical connection between a wire and its respective connecting portion.

Flange area 43 carries a flat front surface 51 which is larger in area than the cross section of mid-body region 47, as shown. The enlarged flange area 43 enhances a user's ability to grip and manipulate the female connector 15. In addition, flange area 43 includes an upper protruding portion 44 which prevents a conventional three pronged plug from being inserted upside down into female receptacle 15. Flat surface 51 provides a face against which a conventional male plug (not shown) may be forced. Such a conventional male plug includes two blade terminals and one prong plug which mate with blade receiving terminals 31, 33 and plug receiving terminal 35, respectively.

Figure 2:
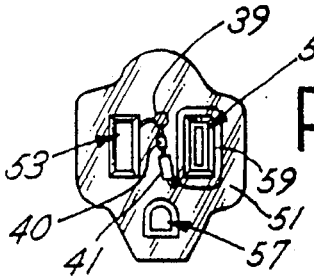
FIG. 2 is a front plan view of a female receptacle of the extension cord of FIG. 1 taken along line 2—2.

With reference to FIGS. 2 and 3, two rectangular passageways 53, 55 are molded in housing 29, opening onto front surface 51 and extending into the mid-body region 47 to the blade receiving terminals 31, 33. Additionally, a dome-shaped passageway 57 opens onto front surface 51 and extends into the mid-body region to ground plug receiving terminal 35. The receiving terminals 31, 33, 35 and the respective passageways 53, 55, 57 are sized so as to receive a conventional 120 VAC three-prong plug.

If desired, female connector 15 may be adapted to accept only a polarized 120 VAC three prong plug. The embodiment shown is constructed for this purpose. A polarizing barrier 59 is formed of LEXAN #141 plastic material and is shaped as a rectangular block having a rectangular aperture 61. Barrier 59 is encapsulated within housing 29 and circumscribes passageway 55 to reinforce the boundaries of passageway 55 thereby preventing incorrect insertion of a polarized male plug. Both passageways 53, 55 are of the same length, but the height of passageway 53 is higher so as to receive the flared metal end of the "hot" blade of a polarized plug.

Housing 29 is a solid, light-permeable body molded from a thermoplastic, for example, polyvinyl chloride ("PVC") material. Housing 29 may be formed from either transparent or translucent material. The connector may be molded from a PVC manufactured by Teknor Apex as compound #1585, the color being called "Water Clear".

Receiving terminals 31, 33, 35, lamp 39, resistor 41, partially sheathed ends of wires 21, 23, 25, barrier 59, and a portion of outer cord sheath 19 are all entirely surrounded by and suspended within the molded housing. Such encapsulation provides the polyvinyl chloride in touching contact with the entire outer surface of each of the components within housing 29 except where passageways 53, 55, 57 contact receiving terminals 31, 33, 35. That is, passageways 53, 55, 57 effectively remove or prevent the encapsulated polyvinyl chloride from a portion of the outer surfaces of receiving terminals 31, 33, 35 at points where electrical contact will be made with a conventional plug forced into passageways 53, 55, 57. Because lamp 39 has polyvinyl chloride in contact with its entire outer surface, there is an absence of oxygen surrounding the lamp and therefore there can be no combustion in that area.

Because of the soft nature of polyvinyl chloride, housing 29 serves as a cushion to absorb mechanical shock which would otherwise be transmitted to the suspended components including lamp 39. In addition, because the crimped mechanical connections are encapsulated, the connections will not jostle loose by rough handling of the cord 11. Thus, the neon lamp 39 and resistor 41 are held in place by their encapsulation.

Figure 4:
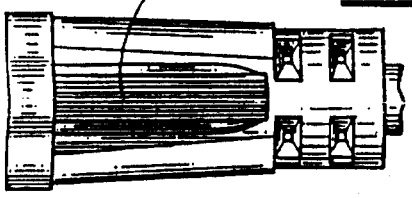
FIG. 4 is a bottom view of the female receptacle of the extension cord of FIG. 1, without a transparent view of the encapsulated components.
Figure 5:
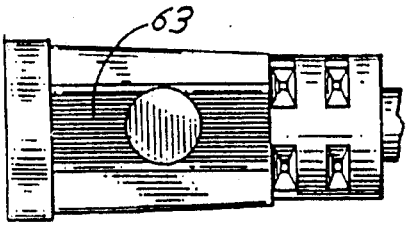
FIG. 5 is a top view of the female receptacle of the extension cord of FIG. 1, without a transparent view of the encapsulated components.

Lamp 39 is viewable from a wide range of viewing angles since housing 29 is light-permeable. The lamp may be positioned in the housing as desired. In addition, line indentations or grooves 63 are molded on the top surface and bottom surface of housing 29, as best seen in FIGS. 4 and 5. These grooves 63 serve to diffract light emanating from lamp 39, bending the light so that light will be received at all viewing angles such that receiving terminals 31, 33, 35 will not block a user's view of light coming from lamp 39. That is, as the user occupies a viewing line sight in which the lamp 39 is hidden behind an encapsulated component within housing 29, a light diffracting groove 63 is arranged on the surface of housing 29 so that light emanating from lamp 39 is bent or refracted along another line of sight to the user. Light diffracting grooves 63 are placed on the outer surface of housing 29 such that there is no single line of sight of the user in which light from lamp 39 cannot reach the user's eyes.

Further, where housing 29 is molded from transparent PVC and the barrier 59 is molded from a solid color material, the barrier can be seen by the user. This provides a warning to the user that the plug receptacle must receive the proper polar blade.

With reference again to FIG. 1, male connector 13 includes a hot blade 65, a neutral blade 67 and a ground plug 69. Hot blade 65 may be provided with a flared end 71 while neutral blade 67 may be provided with a tapered end 73 to adapt the connector for use as a polarized plug.

Blades 65, 67 and ground plug 69 are respectively connected to hot, neutral and ground conducting wires 21, 23, 25. Blades 65, 67 and ground plug 69 are each provided with a connecting portion 75 which is crimped about its respective wire.

Male connector body 77 is a solid, light-permeable body having a front surface 79 and a rear surface 81. Cable 17 extends through the rear surface 81 with its sheath intact. Within the body 77, the sheath has been removed thus allowing the wires 21, 23, 25 to separate and reach the connection portions of the respective blade or ground plug terminals. A small length of the individual sheath respectively surrounding each wire is removed to facilitate electrical contact between the wire and the respective connecting portion.

Male connector body 77 is injection molded as a solid body from polyvinyl chloride which entirely surrounds and encapsulates the blades 65, 67, ground plug 69, wires 21, 23, 35 and a portion of cord 17. Body 77 thus suspends these components therewithin. Portions of blades 65, 67 and ground plug 69 protrude from the male connector body 77 in a direction substantially perpendicular to the plane of the front surface 79 of the male body 77 and are spaced apart within the body 77 to adapt the male connector 13 for use with a standard 120 VAC three-prong outlet.

By suspending the components within the male connector body 77 in the aforesaid fashion, the overall structural integrity of the male connector is increased since the male connector body 77 absorbs much of the mechanical shock which would otherwise be transmitted to these components. As is the case with the female connector body 29, cord 17 and the sheathed portions of wires 21, 23, 25 need not be included within the body 77 provided that the necessary precautions are taken to protect these components from undue mechanical stresses.

As will suggest itself, it may be desirable to include a visual indication of the availability of power within the male connector body 77 in addition to or in lieu of the visual indicator within the female connector body 29. Thus, a series connected resistor and lamp may be connected between the blades 65, 67 or, alternatively, between hot blade 65 and ground plug 69 within the male connector body 77.

As will be apparent to those of ordinary skill in the art, numerous changes can be made to adapt the extension cord for a particular use. The bodies 29, 77 can be formed from light permeable materials other than polyvinyl chloride, however a shock absorbable material is desired. Other shapes for the connector bodies 29, 77 may also be contemplated. The shape and relative spacing of the receiving terminals and blade terminals within the respective bodies may likewise vary dependent on whether the extension cord is to be constructed for use with 120 VAC, 240 VAC, three phase, or other power schemes.

In addition, electrical connector 15 may be shaped as an adaptor rather than being directly connected to the wires of an extension cord. As an adaptor, male prongs will be carried at rear surface 45 similar to prongs 65,67,69 carried by plug connector 13, and rear surface 45 may be shaped similar to surface 79. The wires 21, 23, 35 disposed between the receiving terminals and plug terminals of such an adaptor will be short and totally encapsulated within the housing of the adaptor. Such an adaptor is an electrical connector as that term is used herein.

While preferred embodiments of the invention have been described hereinabove, those of ordinary skill in the art will recognize that the embodiments may be modified and altered without departing from the central spirit and scope of the invention. Thus, the preferred embodiments described hereinabove are to be considered in all respects as illustrative and not restrictive, the scope of the invention being indicated by the appended claims rather than by the foregoing description. Therefore, all changes and modifications which come within the meaning and range of equivalency of the claims are intended to be embraced herein.

What is claimed is:

1. An electrical connector for use at one of the connection ends of an extension cord for mating with a conventional electrical connector device, comprising:

a plurality of electrical connection elements arranged relative to one another for mating with a conventional electrical connector device;

a plurality of wire conductors each electrically connected to separate one of said connection elements for developing a voltage drop across at least two of said elements;

visual indicating means including a voltage activated lamp for visually indicating by light from said lamp that power is available at said connection elements, said visual indicating means being electrically connected to said elements for activating said lamp to light when voltage is developed across said two elements;

a plug body molded entirely of a solid, light-permeable plastic and encapsulating said plurality of electrical connection elements and said visual indicating means, said plug body being molded for solidly encapsulating said lamp preventing any movement of said lamp relative to said plug body for protecting said lamp from mechanical shock;

a plurality of grooves molded from said solid light-permeable plastic and into the outer surface of said plug body and each of said grooves having a peak, said grooves positioned at locations on said plug body such that light from said visual light source, even if directly occluded by encapsulated electrical connection elements or said extension cord, is diffracted to each line of sight around the entire body of the plug so that no single line of sight exists where said light cannot be viewed.

2. An electrical connector according to claim 1, wherein said solid, light-permeable plastic body is transparent.

3. An electrical connector according to claim 1, wherein said solid, light-permeable plastic body is translucent, permitting light from said lamp to emanate through said body.

4. An electrical connector according to claim 1, wherein said solid light-permeable body is formed from a thermoplastic material.

5. An electrical connector according to claim 4, wherein said thermoplastic material is polyvinyl chloride.

6. An electrical connector according to claim 1, wherein said two connection elements include two blade receiving terminals spaced within said solid, light-permeable body and shaped to accept the blades of a conventional plug connector device.

7. An electrical connector according to claim 6 wherein one of said plurality of electrical connection elements includes:

a ground plug receiving terminal for accepting a ground plug from a conventional plug connector device.

8. An electrical connector according to claim 1 wherein said body is a single solidly molded unit encapsulating both said plurality of electrical connection elements and said visual indicating means.

9. An electrical connector according to claim 1, wherein said two connection elements include two blade terminals spaced apart within and projecting from said solid, light-permeable body and shaped to be insertable within a conventional power outlet connector device.

10. An electrical connector according to claim 1, wherein said visual indicating means further comprises an impedance device connected in series with said lamp, said series connected lamp and impedance device being connected across said two connection elements.

11. An electrical connector according to claim 10 wherein said impedance device is a resistor.

12. An electrical connector according to claim 11 wherein said visual indicating means includes a crimped brass ring, said lamp and said resistor being mechanically connected in electrical contact by said crimped brass ring.

13. An electrical connector according to claim 6, wherein said solid, light-permeable plug body includes at least two openings, each communicating a separate one of said blade receiving terminals to the exterior of said body; and further including a sole barrier ring circumscribing only one of said openings, said barrier ring being encapsulated within said body.

14. An electrical connector according to claim 6, wherein said solid, light-permeable body includes a flange member having a plug confronting flat surface.

15. An extension cord for mating with conventional electrical connector devices, comprising:

a first light-permeable plug body being molded of a material for absorbing mechanical shock;

a second light-permeable plug body being molded of a material for absorbing mechanical shock;

a plurality of electrical connection elements associated with each of said light-permeable plug bodies, arranged relative to one another for mating with a conventional electrical connector device;

a plurality of wire conductors each electrically connected to a separate one of said electrical connection elements for developing a voltage drop across at least two of said connection elements;

a visual indicator assembly visually indicating that power is available at said connection elements, said visual indicating means being electrically connected to said two elements for activating said visual indicator when voltage is developed across said two elements;

said visual indicator assembly including a lamp for emitting light which is encapsulated within either said first light-permeable plug body or said second light-permeable plug body;

each of said light-permeable plug bodies molded around said plurality of electrical connection elements, said plurality of wire conductors, and said visual indicator to prevent movement of said visual indicator assembly and to protect the electrical connections of said plurality of wire conductors and said respective electrical connectors; and said plug body having a plurality of grooves formed on said plug body at locations such that light from said visual light source, even if directly occluded by said encapsulated electrical connector elements or said wire conductors is diffracted to each line of sight around the entire plug body so that no single line of sight exists where said light cannot be viewed.

16. The electrical connector of claim 15 wherein said first light-permeable plug body is a male connector body.

17. The electrical connector of claim 16 wherein said electrical connector elements are hot and neutral connector blades.

18. The electrical connector of claim 17 wherein said electrical connector elements includes a ground connector blade.

19. The electrical connector for claim 15 wherein said second light-permeable plug body is a female connector body.

20. The electrical connector for claim 19 wherein said electrical connector elements are hot and neutral receiving terminals.

21. The electrical connector for claim 20 wherein said electrical connector elements includes a ground receiving terminal.

22. The electrical connector of claim 15 wherein said visual indication assembly includes a crimped brass ring, a lamp and a resistor being mechanically connected in electrical contact by said crimped brass ring.

23. A method of providing an indication of the availability of power from an electrical extension cord to every line of sight, comprising the steps of:

providing a visual indicator which visually indicates by light from a lamp that power is available to said extension cord;

providing a plurality of electrical connection elements arranged relative to one another for mating with a conventional electrical connector device;

connecting said visual indicator to two of said plurality of electrical connection elements for activating said visual indicator when voltage is developed across said two elements;

molding a first plug body out of a light-permeable material at one end of said extension cord having a light-permeable outer surface;

encapsulating said visual indicator and said plurality of electrical connection elements within said first plug body during said molding; and molding a plurality of light diffracting grooves in the outer surfaces of said first plug body at locations such that light which emanates from said visual indicator even if directly occluded by said encapsulated electrical connection elements, is diffracted to each line of sight around the entire plug body so that said light can be seen from any viewing angle.

* * * * *